US010788779B2

(12) United States Patent
Suga et al.

(10) Patent No.: US 10,788,779 B2
(45) Date of Patent: Sep. 29, 2020

(54) BELT DEVIATION DETECTION DEVICE, BELT DEVICE, IMAGE FORMING APPARATUS, AND METHOD OF MANUFACTURING CONTACT MEMBER

(71) Applicants: Tomoaki Suga, Kanagawa (JP); Takahiro Konishi, Tokyo (JP)

(72) Inventors: Tomoaki Suga, Kanagawa (JP); Takahiro Konishi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/451,407

(22) Filed: Jun. 25, 2019

(65) Prior Publication Data

US 2020/0064765 A1 Feb. 27, 2020

(30) Foreign Application Priority Data

Aug. 27, 2018 (JP) ..... 2018-157986

(51) Int. Cl.
*G03G 15/16* (2006.01)
*G03G 15/00* (2006.01)

(52) U.S. Cl.
CPC ..... *G03G 15/5054* (2013.01); *G03G 15/1615* (2013.01)

(58) Field of Classification Search
CPC ..... G03G 15/1675; G03G 15/1605; G03G 15/1665; G03G 2215/0132; G03G 15/161
USPC ..... 399/66
See application file for complete search history.

(56) References Cited

U.S. PATENT DOCUMENTS 6,881,125 B1 * 4/2005 Wada ..... B24B 9/148 451/251
2006/0152740 A1 * 7/2006 Cavallucci ..... G06F 3/0421 356/614
2008/0240802 A1 * 10/2008 Nakura ..... G03G 15/161 399/313
2015/0054212 A1 * 2/2015 Fujihara ..... G07D 7/121 271/3.2
2015/0346643 A1 12/2015 Konishi et al.
2015/0346651 A1 12/2015 Nagata et al.
2017/0010566 A1 1/2017 Kato et al.
2017/0168429 A1 6/2017 Imai et al.

FOREIGN PATENT DOCUMENTS

JP 2012-093776 5/2012

* cited by examiner

*Primary Examiner* — Walter L Lindsay, Jr.
*Assistant Examiner* — Frederick Wenderoth
(74) *Attorney, Agent, or Firm* — Harness, Dickey and Pierce, P.L.C.

(57) ABSTRACT

A belt deviation detection device detects lateral displacement of a rotary belt in a width direction of the belt. The belt deviation detection device includes a contact member in contact with the belt at a contact portion of the contact member, a biasing member configured to bias the contact member toward the belt to press the contact member against the belt, and a displacement detector configured to detect the displacement of the belt in the width direction of the belt. The contact member is configured to track the displacement of the belt in the width direction of the belt. The contact member is made of a metal material, and a hardening treatment is applied to at least the contact portion of the contact member.

18 Claims, 6 Drawing Sheets

BELT DEVIATION DETECTION DEVICE, BELT DEVICE, IMAGE FORMING APPARATUS, AND METHOD OF MANUFACTURING CONTACT MEMBER

CROSS-REFERENCE TO RELATED APPLICATION

This patent application is based on and claims priority pursuant to 35 U.S.C. § 119(a) to Japanese Patent Application No. 2018-157986, filed on Aug. 27, 2018, in the Japan Patent Office, the entire disclosure of which is hereby incorporated by reference herein.

BACKGROUND

Technical Field

Embodiments of the present disclosure relate to a belt deviation detection device configured to detect a lateral displacement of a belt in a width direction of the belt, such as an intermediate transfer belt, a transfer conveyance belt, a photoconductor belt, or the like that rotates in a predetermined direction, a belt device, an image forming apparatus incorporating the belt deviation detection device, and a method of manufacturing a contact member included in the belt deviation detection device.

Description of the Related Art

Certain image forming apparatuses include a belt deviation detection device configured to detect a displacement of an intermediate transfer belt, which rotates in a predetermined direction, in a width direction of the intermediate transfer belt.

SUMMARY

Embodiments of the present disclosure describe an improved belt deviation detection device to detect lateral displacement of a rotary belt in a width direction of the belt. The belt deviation detection device includes a contact member in contact with the belt at a contact portion of the contact member, a biasing member configured to bias the contact member toward the belt to press the contact member against the belt, and a displacement detector configured to detect the displacement of the belt in the width direction. The contact member is configured to track the displacement of the belt in the width direction of the belt. The contact member is made of a metal material, and a hardening treatment is applied to at least the contact portion of the contact member.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein:

FIGS. 6A-1, 6B-1, and 6C-1 are schematic views illustrating a vicinity of a transmissive photosensor included in the belt deviation detection device;

FIGS. 6A-2, 6B-2, and 6C-2 are graphs illustrating an output change of the transmissive photosensor.

Figure 1:
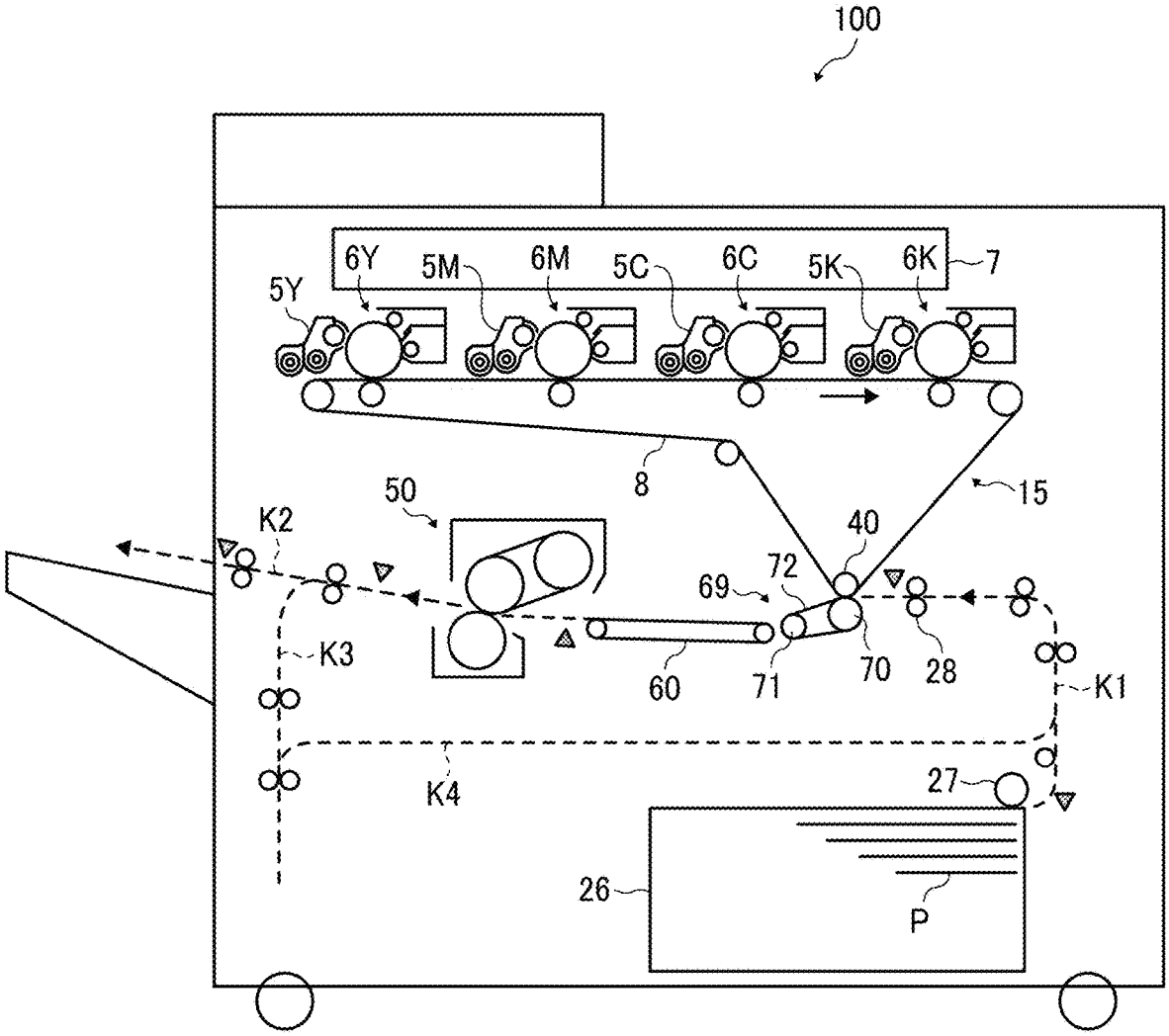
FIG. 1 is a schematic view illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

Embodiments of the present disclosure are described in detail with reference to the appended drawings. It is to be understood that identical or similar reference numerals are assigned to identical or corresponding components throughout the drawings, and redundant descriptions are omitted or simplified below as required.

Figure 2:
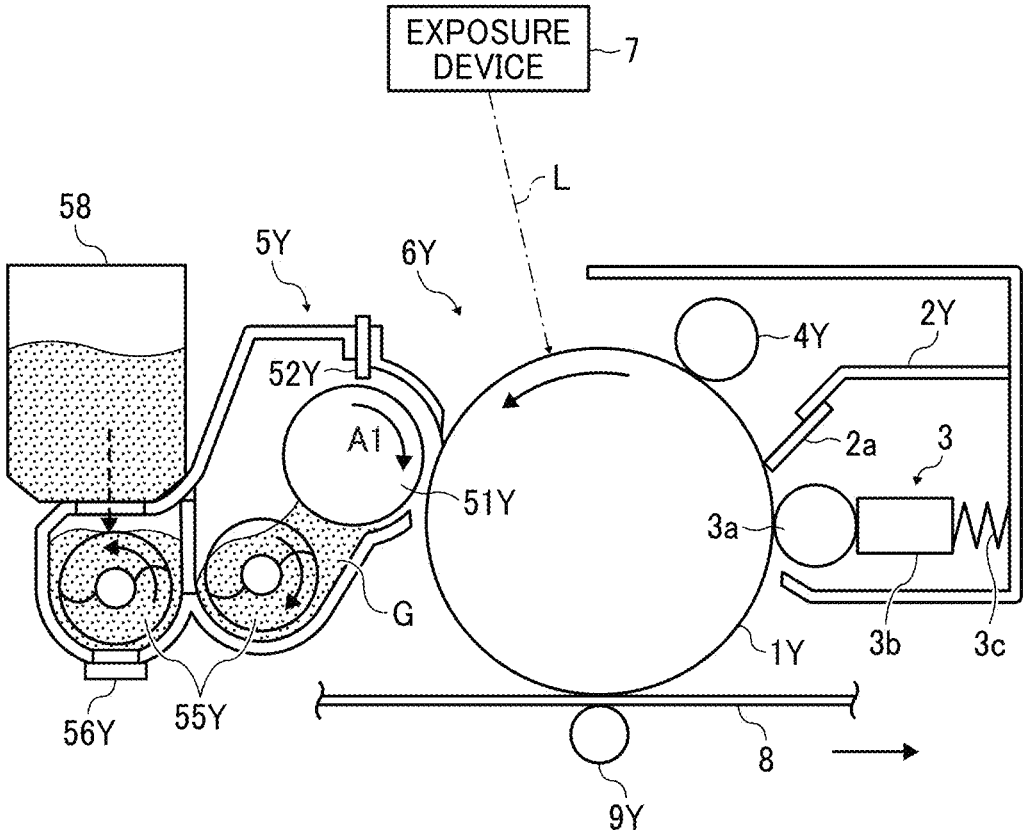
FIG. 2 is a schematic cross-sectional view of an image forming unit of the image forming apparatus in FIG. 1.

With reference to FIGS. 1 and 2, a configuration and operation of an image forming apparatus 100 according to the present embodiment are described below.

FIG. 1 is a schematic view illustrating the configuration of the image forming apparatus 100, which in the present embodiment is a printer. FIG. 2 is an enlarged cross-sectional view illustrating a part of an image forming unit 6Y of the image forming apparatus 100.

As illustrated in FIG. 1, the image forming apparatus 100 includes an intermediate transfer belt device 15 as a belt device at the center of the apparatus body of the image forming apparatus 100. The image forming units 6Y, 6M, 6C, and 6K are arranged in parallel, facing an intermediate transfer belt 8 as a belt of the intermediate transfer belt device 15 to form toner images of yellow, magenta, cyan, and black, respectively. Below the intermediate transfer belt device 15, a secondary transfer belt device 69 is disposed.

With reference to FIG. 2, the image forming unit 6Y for yellow includes a photoconductor drum 1Y and further includes a charging device 4Y, a developing device 5Y, a cleaning device 2Y, a lubricant applicator 3, and a discharger disposed around the photoconductor drum 1Y. Image forming processes, namely, charging, exposure, development, transfer, and cleaning processes, are performed on the photoconductor drum 1Y, and thus a yellow toner image is formed on a surface of the photoconductor drum 1Y.

The other three image forming units 6M, 6C, and 6K have a similar configuration to that of the yellow image forming unit 6Y except for the color of toner used therein and form magenta, cyan, and black toner images, respectively. Thus, only the image forming unit 6Y is described below and descriptions of the other three image forming units 6M, 6C, and 6K are omitted.

With reference to FIG. 2, the photoconductor drum 1Y is rotated counterclockwise in FIG. 2 by a main motor. The charging device 4Y uniformly charges the surface of the photoconductor drum 1Y at a position opposite the charging device 4Y (a charging process).

Then, the charged surface of the photoconductor drum 1Y reaches a position to receive a laser beam L emitted from an exposure device 7, and the photoconductor drum 1Y is scanned with the laser beam L in a width direction at the position, thereby forming an electrostatic latent image for yellow on the surface of the photoconductor drum 1Y (an exposure process). The width direction is a main-scanning direction perpendicular to the surface of the paper on which FIGS. 1 and 2 are drawn.

The surface of the photoconductor drum 1Y carrying the electrostatic latent image reaches a position opposite the developing device 5Y, and the electrostatic latent image is developed into a toner image of yellow at the position (a development process).

When the surface of the photoconductor drum 1Y carrying the toner image reaches a position opposite a primary transfer roller 9Y via the intermediate transfer belt 8, the toner image on the surface of the photoconductor drum 1Y is transferred onto a surface of the intermediate transfer belt 8 at the position (a primary transfer process). After the primary transfer process, a certain amount of untransferred toner remains on the photoconductor drum 1Y.

When the surface of the photoconductor drum 1Y reaches a position opposite the cleaning device 2Y, a cleaning blade 2*a* of the cleaning device 2Y collects the untransferred toner from the photoconductor drum 1Y into the cleaning device 2Y (a cleaning process).

The cleaning device 2Y includes a lubricant supply roller 3*a*, a solid lubricant 3*b*, and a compression spring 3*c*, which constitute the lubricant applicator 3 for the photoconductor drum 1Y. The lubricant supply roller 3*a* rotating clockwise in FIG. 2 rubs a small amount of lubricant from the solid lubricant 3*b* and applies the lubricant to the surface of the photoconductor drum 1Y.

Subsequently, the surface of the photoconductor drum 1Y reaches a position opposite the discharger, and the discharger eliminates a residual potential from the photoconductor drum 1Y.

Thus, a sequence of image forming processes performed on the photoconductor drum 1Y is completed.

The above-described image forming processes are performed in the image forming units 6M, 6C, and 6K similarly to the yellow image forming unit 6Y. That is, the exposure device 7 disposed above the image forming units 6M, 6C, and 6K irradiates photoconductor drums 1M, 1C, and 1K of the image forming units 6M, 6C, and 6K with the laser beams L based on image data. Specifically, the exposure device 7 includes a light source to emit the laser beams L, multiple optical elements, and a polygon mirror that is rotated by a motor. The exposure device 7 directs the laser beams L to the photoconductor drums 1M, 1C, and 1K via the multiple optical elements while deflecting the laser beams L with the polygon mirror. Alternatively, an exposure device 7 in which a plurality of light emitting diodes (LEDs) is arranged side by side in the width direction can be used.

Then, the toner images formed on the photoconductor drums 1M, 1C, and 1K through the development process of developing devices 5M, 5C, and 5K are primarily transferred therefrom and superimposed onto the intermediate transfer belt 8. Thus, a multicolor toner image is formed on the intermediate transfer belt 8.

Figure 3:
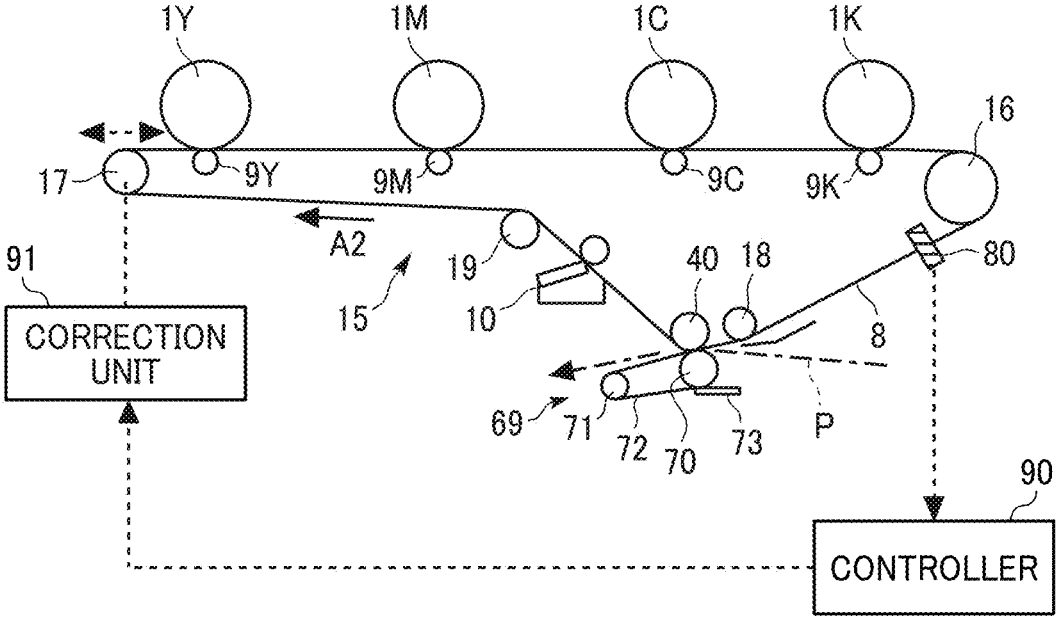
FIG. 3 is a schematic view of a belt device of the image forming apparatus in FIG. 1.

The intermediate transfer belt 8 as the belt is stretched and supported around a plurality of rollers 16 through 19 and 40 and is rotated by a drive roller 16 driven by a drive motor in a direction indicated by arrow A2 in FIG. 3.

The four primary transfer rollers 9Y, 9M, 9C, and 9K are pressed against the corresponding photoconductor drums 1Y, 1M, 1C, and 1K, respectively, via the intermediate transfer belt 8 to form primary transfer nips. Transfer voltages (primary transfer biases) opposite in polarity to that of toner are applied to the primary transfer rollers 9Y, 9M, 9C, and 9K.

While rotating in the direction indicated by arrow A2 in FIG. 3, the intermediate transfer belt 8 passes through the primary transfer nips between the photoconductor drums 1Y, 1M, 1C, and 1K and the respective primary transfer rollers 9Y, 9M, 9C, and 9K. Then, the single-color toner images on the photoconductor drums 1Y, 1M, 1C, and 1K are primarily transferred and superimposed onto the intermediate transfer belt 8, thereby forming the multicolor toner image on the intermediate transfer belt 8 (a primary transfer process).

Then, the intermediate transfer belt 8 carrying the multicolor toner image reaches a position opposite a secondary transfer belt 72. A secondary-transfer backup roller 40 and a secondary transfer roller 70 press against each other via the intermediate transfer belt 8 and the secondary transfer belt 72, thereby forming a secondary transfer nip. The multicolor (four-color) toner image on the intermediate transfer belt 8 is transferred onto a sheet P (e.g., a paper sheet) conveyed to the secondary transfer nip (a secondary transfer process). At that time, toner that is not transferred onto the sheet P remains on the surface of the intermediate transfer belt 8.

Then, the intermediate transfer belt 8 reaches a position opposite a belt cleaner 10 of the intermediate transfer belt device 15. At this position, the belt cleaner 10 removes substances adhering to the intermediate transfer belt 8 (e.g., untransferred toner) to complete a series of image transfer processes performed on the intermediate transfer belt 8.

With reference to FIG. 1, the sheet P is conveyed from a sheet feeder 26 disposed in a lower portion of the apparatus body of the image forming apparatus 100 to the secondary transfer nip via a feed roller 27 and a registration roller pair 28.

Specifically, the sheet feeder 26 contains a stack of multiple sheets P such as paper sheets piled one on another. As the feed roller 27 rotates counterclockwise in FIG. 1, the topmost sheet P of the stack of multiple sheets P in the sheet feeder 26 is fed toward a nip between the registration roller pair 28 via a first conveyance path K1.

The registration roller pair (a timing roller pair) 28 temporarily stops rotating, stopping the sheet P with a leading edge of the sheet P nipped in the registration roller pair 28. The registration roller pair 28 rotates to convey the sheet P to the secondary transfer nip, timed to coincide with the arrival of the multicolor toner image on the intermediate transfer belt 8. Thus, the desired multicolor toner image is transferred onto the sheet P.

The sheet P, onto which the multicolor toner image is secondarily transferred at the secondary transfer nip, is conveyed on the secondary transfer belt 72 and separated from the secondary transfer belt 72, and then a conveyance belt 60 conveys the sheet P to a fixing device 50. In the fixing device 50, a fixing belt and a pressing roller apply heat and pressure to the sheet P to fix the multicolor toner image on the sheet P (a fixing process).

The sheet P is conveyed through a second conveyance path K2 and ejected by an output roller pair to the outside of the image forming apparatus 100. The sheets P ejected by the output roller pair are sequentially stacked as output images on a stack tray to complete a series of image forming processes (printing operations) performed by the image forming apparatus 100.

Thus, in single-side printing, the sheet P is ejected after the toner image is fixed on the front side of the sheet P. By contrast, in duplex printing to form toner images on both sides (front side and back side) of the sheet P, the sheet P is guided to a third conveyance path K3. After a direction of conveyance of the sheet P is reversed, the sheet P is conveyed again to the secondary transfer nip (a secondary transfer belt device 69) via a fourth conveyance path K4. Then, through the image forming processes (the printing operations) similar to those described above, the toner image is transferred onto the back side of the sheet P at the secondary transfer nip and fixed thereon by the fixing device 50, after which the sheet P is ejected from the image forming apparatus 100 via the second conveyance path K2.

Next, a detailed description is provided of a configuration and operations of the developing device 5Y with reference to FIG. 2.

The developing device 5Y includes a developing roller 51Y opposed to the photoconductor drum 1Y, a doctor blade 52Y opposed to the developing roller 51Y, two conveying screws 55Y disposed in a developer storage of the developing device 5Y, and a toner concentration sensor 56Y to detect a toner concentration in a developer G. The developing roller 51Y includes stationary magnets, a sleeve that rotates around the magnets, and the like. The developer storage contains the two-component developer G including carrier and toner.

The developing device 5Y with such a configuration operates as follows.

The sleeve of the developing roller 51Y rotates in the direction indicated by arrow A1 in FIG. 2. The developer G is carried on the developing roller 51Y by a magnetic field generated by the magnets. As the sleeve rotates, the developer G moves along a circumference of the developing roller 51Y. A ratio of toner to carrier (i.e., toner concentration) in the developer G contained in the developing device 5Y is adjusted within a predetermined range. Specifically, when low toner concentration is detected by the toner concentration sensor 56Y disposed in the developing device 5Y, fresh toner is supplied from a toner container 58 to the developer storage of the developing device 5Y to keep the toner concentration within the predetermined range.

The two conveying screws 55Y stir and mix the developer G with the toner supplied from the toner container 58 to the developer storage while circulating the developer G in the developer storage separated into two compartments. In this case, the developer G moves in the direction perpendicular to the surface of the paper on which FIG. 2 is drawn. The toner in developer G is triboelectrically charged by friction with the carrier and electrostatically attracted to the carrier. Then, the toner is carried on the developing roller 51Y together with the carrier by magnetic force generated on the developing roller 51Y.

The developer G on the developing roller 51Y is carried in the direction indicated by arrow A1 in FIG. 2 to the doctor blade 52Y. An amount of developer G on the developing roller 51Y is adjusted by the doctor blade 52Y, after which the developer G is carried to a development range opposed to the photoconductor drum 1Y. The toner in the developer G is attracted to the latent image formed on the photoconductor drum 1Y due to the effect of an electric field generated in the development range. As the sleeve rotates, the developer G remaining on the developing roller 51Y reaches an upper part of the developer storage and separates from the developing roller 51Y.

The replaceable toner container 58 is detachably attached to the developing device 5Y (the image forming apparatus 100). When the toner container 58 runs out of fresh toner, the toner container 58 is detached from the developing device 5Y (the image forming apparatus 100) and replaced with a new one.

Now, a detailed description is given of a belt deviation detection device 80 included in the intermediate transfer belt device 15 of the image forming apparatus 100 according to the present embodiment, with reference to FIGS. 3 through 7B.

Figure 4:
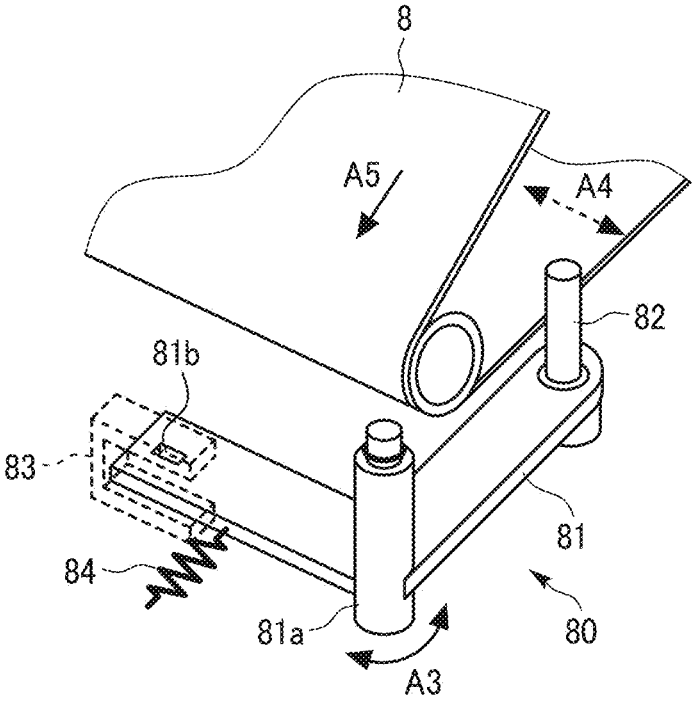
FIG. 4 is a perspective view of a belt deviation detection device according to an embodiment of the present disclosure.

With reference to FIGS. 3 and 4, the intermediate transfer belt device 15 as the belt device includes the intermediate transfer belt 8 as the belt, the four primary transfer rollers 9Y, 9M, 9C, and 9K, the drive roller 16, a correction roller 17, a correction unit 91, a pre-transfer roller 18, a tension roller 19, the belt cleaner 10 for the intermediate transfer belt 8, the secondary-transfer backup roller 40, the belt deviation detection device 80, and the like.

The intermediate transfer belt 8 is disposed in contact with the four photoconductor drums 1Y, 1M, 1C, and 1K to bear the toner images of the respective colors, thereby forming the primary transfer nips. The intermediate transfer belt 8 is stretched taut around and supported by multiple rollers: the drive roller 16, the correction roller 17, the pre-transfer roller 18, the tension roller 19, the secondary-transfer backup roller 40, and the like.

According to the present embodiment, the intermediate transfer belt 8 includes a single layer or multiple layers including, but not limited to, polyimide (PI), polyvinylidene fluoride (PVDF), ethylene-tetrafluoroethylene copolymer (ETFE), and polycarbonate (PC), with conductive material such as carbon black dispersed therein. The volume resistivity of the intermediate transfer belt 8 is adjusted within a range of from $10^7$ to $10^{12}$ Ωcm, and the surface resistivity of a back surface of the intermediate transfer belt 8 is adjusted within a range of from $10^8$ to $10^{12}$ Ω/sq. The thickness of the intermediate transfer belt 8 ranges from 80 to 100 μm. In the present embodiment, the thickness of the intermediate transfer belt 8 is 90 μm.

In some embodiments, the intermediate transfer belt 8 may include a release layer coated on the surface of the intermediate transfer belt 8 as needed. Examples of a material usable for the release layer include, but are not limited to, fluorocarbon resins such as ETFE, polytetrafluoroethylene (PTFE), PVDF, perfluoroalkoxy polymer resin (PFA), tetrafluoroethylene-hexafluoropropylene copolymer (FEP), and polyvinyl fluoride (PVF).

The intermediate transfer belt 8 is manufactured through a casting process, a centrifugal molding process, or the like. The surface of the intermediate transfer belt 8 may be polished as necessary.

The primary transfer rollers 9Y, 9M, 9C, and 9K are disposed in contact with the photoconductor drums 1Y, 1M, 1C, and 1K via the intermediate transfer belt 8, respectively. Specifically, the primary transfer roller 9Y for yellow is disposed in contact with the photoconductor drum 1Y for yellow via the intermediate transfer belt 8. The primary transfer roller 9M for magenta is disposed in contact with the photoconductor drum 1M for magenta via the intermediate transfer belt 8. The primary transfer roller 9C for cyan is disposed in contact with the photoconductor drum 1C for cyan via the intermediate transfer belt 8. The primary transfer roller 9K for black is disposed in contact with the photoconductor drum 1K for black via the intermediate transfer belt 8. Each of the primary transfer rollers 9Y, 9M, 9C, and 9K is an elastic roller including a core and a conductive foamed layer on the core. The volume resistivity of each of the primary transfer rollers 9Y, 9M, 9C, and 9K is adjusted within a range of from $10^6$ to $10^{12}$ Ωcm, preferably from $10^7$ to $10^9$ Ωcm.

The drive roller 16 is disposed in contact with an inner circumferential surface of the intermediate transfer belt 8 by an angle of belt winding of about 120 degrees at a position downstream from the four photoconductor drums 1Y, 1M, 1C, and 1K in a direction of rotation of the intermediate transfer belt 8. The drive roller 16 is rotated clockwise in FIG. 3 by the drive motor, which is controlled by a controller 90. Such a configuration allows the intermediate transfer belt 8 to rotate in a predetermined direction (i.e., clockwise in FIG. 3) as indicated by arrow A2 in FIG. 3.

The correction roller 17 is disposed in contact with the inner circumferential surface of the intermediate transfer belt 8 by the angle of belt winding of about 180 degrees at a position upstream from the four photoconductor drums 1Y, 1M, 1C, and 1K in the direction of rotation of the intermediate transfer belt 8. A portion of the intermediate transfer belt 8 from the correction roller 17 to the drive roller 16 is arranged approximately horizontal. The correction roller 17 is rotated clockwise in FIG. 3 as the intermediate transfer belt 8 rotates.

The correction roller 17 is coupled to the correction unit 91. The correction roller 17 together with the correction unit 91 functions as a correction device that corrects a belt deviation (a displacement in the width direction) of the intermediate transfer belt 8 based on the detection result of the belt deviation of the intermediate transfer belt 8 by the belt deviation detection device 80. Detailed descriptions of the belt deviation detection device 80 and the correction device are deferred.

The tension roller 19 is in contact with an outer circumferential surface of the intermediate transfer belt 8. The pre-transfer roller 18 and the secondary-transfer backup roller 40 are in contact with the inner circumferential surface of the intermediate transfer belt 8.

As the intermediate transfer belt 8 rotates, the plurality of rollers 17 through 19 and 40 other than the drive roller 16 is driven to rotate.

The belt cleaner 10 is disposed between the secondary-transfer backup roller 40 and the tension roller 19. The belt cleaner 10 includes a cleaning blade.

With reference to FIG. 3, the secondary-transfer backup roller 40 is in contact with the secondary transfer roller 70 via the intermediate transfer belt 8 and the secondary transfer belt 72. The secondary-transfer backup roller 40 includes a cylindrical core made of, for example, stainless steel or the like, having an elastic layer on an outer circumferential surface of the core. The elastic layer is made of acrylonitrile-butadiene rubber (NBR). The elastic layer has the volume resistivity ranging from approximately $10^7$ to $10^8$ Ωcm, and a hardness ranging from approximately 48 to 58 degrees on Japanese Industrial Standards A hardness (hereinafter, referred to as JIS-A hardness) scale. The elastic layer has a thickness of approximately 5 mm.

According to the present embodiment, the secondary-transfer backup roller 40 is electrically connected to a power source that applies a high voltage of approximately −5 kV as a secondary transfer bias to the secondary-transfer backup roller 40. With the secondary transfer bias applied to the secondary-transfer backup roller 40, the toner image primarily transferred to the surface of the intermediate transfer belt 8 is secondarily transferred onto the sheet P conveyed to the secondary transfer nip. The secondary transfer bias has the same polarity as the polarity of toner. In the present embodiment, the secondary transfer bias is a direct current (DC) voltage and has a negative polarity to transfer the toner image by repulsion. With this configuration, the toner carried on the outer circumferential surface (a surface bearing the toner) of the intermediate transfer belt 8 electrostatically moves from the secondary-transfer backup roller 40 side toward the secondary transfer belt device 69 due to a secondary transfer electric field.

In another embodiment, the secondary transfer bias may be an alternating current (AC) voltage superimposed on a DC voltage. In yet another embodiment, the secondary transfer bias may be applied to the secondary transfer roller 70 to transfer the toner image by attraction.

The secondary transfer belt device 69 includes the secondary transfer belt 72, the secondary transfer roller 70, a separation roller 71, and a secondary-transfer cleaning blade 73.

The secondary transfer belt 72 is an endless belt stretched taut around multiple rollers (i.e., the secondary transfer roller 70 and the separation roller 71). The secondary transfer belt 72 is made of a material similar to that of the intermediate transfer belt 8. The secondary transfer belt 72 is in contact with the intermediate transfer belt 8 to form the secondary transfer nip and conveys the sheet P fed from the secondary transfer nip.

The secondary-transfer backup roller 40 and the secondary transfer roller 70 press against each other via the intermediate transfer belt 8 and the secondary transfer belt 72, thereby forming the secondary transfer nip.

The separation roller 71 is disposed downstream from the secondary transfer nip in the direction of conveyance of the sheet P. Ejected from the secondary transfer nip, the sheet P is conveyed along the secondary transfer belt 72 rotating counterclockwise in FIG. 3 and separated from the secondary transfer belt 72 at a curved portion of the secondary transfer belt 72 wound around an outer circumference of the separation roller 71 due to self-stripping.

The secondary-transfer cleaning blade 73 is in contact with the surface of the secondary transfer belt 72 to remove substances such as toner and paper dust adhering to the surface of the secondary transfer belt 72.

The intermediate transfer belt device 15 according to the present embodiment includes the belt deviation detection device 80 configured to detect the displacement of the intermediate transfer belt 8 (i.e., the belt deviation) laterally in the width direction (the direction perpendicular to the surface of the paper on which FIG. 3 is drawn) when the intermediate transfer belt 8 rotates in the predetermined direction.

Specifically, with reference to FIG. 4, the belt deviation detection device 80 includes a contact member 82 in contact with the intermediate transfer belt 8, an arm 81 to which the contact member is attached, a transmissive photosensor (a photo interrupter) 83 as a displacement detector configured to indirectly detect the lateral displacement of the intermediate transfer belt 8, and a tension spring 84 as a biasing member to bias the contact member 82 attached to the arm 81 so that the contact member 82 contacts the intermediate transfer belt 8. The displacement of the intermediate transfer belt 8 (i.e., the belt deviation) includes an amount of displacement and a direction of displacement of the intermediate transfer belt 8.

The contact member 82 is in contact with the intermediate transfer belt 8 due to the biasing force of the tension spring 84 as the biasing member and tracks the displacement of the intermediate transfer belt 8 in the width direction of the intermediate transfer belt 8.

Specifically, the contact member 82 is cylindrical and held in a non-rotational manner so as to stand on one end side of the L-shaped arm 81. Further, the contact member 82 is in contact with the intermediate transfer belt 8 such that a longitudinal direction of the contact member 82 is substantially perpendicular to the end in the width direction (i.e., the side edge) of the intermediate transfer belt 8. In the present embodiment, the contact member 82 is made of a metal material such as stainless steel or the like to which a hardening treatment such as a heat treatment or a surface modification treatment is applied, which is described in detail later.

The arm 81 is a substantially L-shaped plate made of a resin material and held by a casing of the intermediate transfer belt device 15 so as to be swingable around a spindle 81*a* in the direction indicated by the solid double arrow A3 in FIG. 4. The cylindrical contact member 82 is fitted to the one end side of the arm 81. On the other end side of the arm 81, a slit 81*b* penetrates the arm 81 in the thickness direction. In the present embodiment, the arm 81 and the contact member 82 are individually formed as separated pieces. Alternatively, the arm 81 and the contact member 82 can be formed as a single piece.

One end of the tension spring 84 as the biasing member is coupled to the other end side of the arm 81, the side on which the contact member 82 is not disposed. The other end of the tension spring 84 is coupled to the casing of the intermediate transfer belt device 15.

With such a configuration, the arm 81 swings along with the contact member 82 in the direction indicated by solid double arrow A3 in FIG. 4, following the displacement of the intermediate transfer belt 8 in the width direction of the intermediate transfer belt 8, which is the direction of the belt deviation indicated by the double-headed arrow A4 in FIG. 4.

Figure 5:
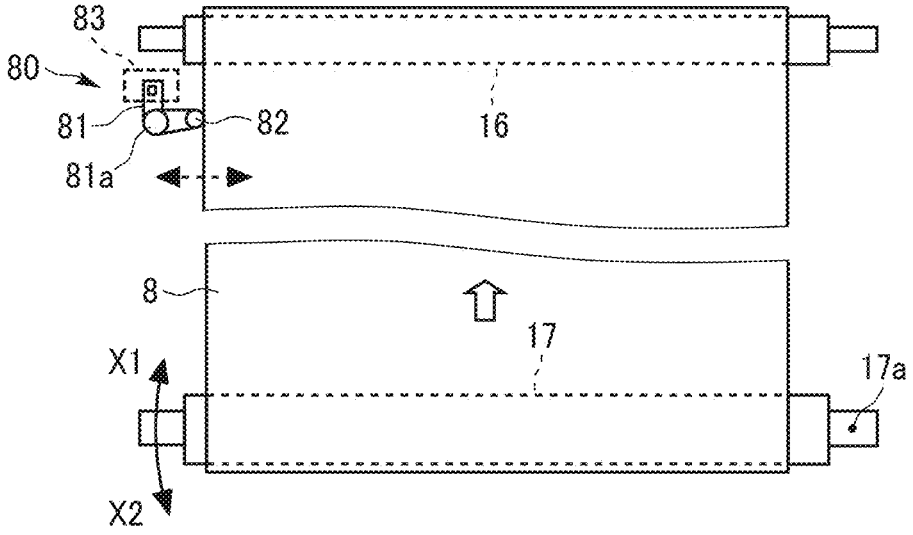
FIG. 5 is a schematic view of a part of the belt device in FIG. 3 as viewed in a width direction of a belt included in the belt device.

Specifically, when the intermediate transfer belt 8 shifts to the left in FIG. 5, the contact member 82 moves in the same direction against the biasing force of the tension spring 84, and the arm 81 swings around the spindle 81*a* clockwise in FIG. 5. On the other hand, when the intermediate transfer belt 8 shifts to the right in FIG. 5, the contact member 82 moves in the same direction by the biasing force of the tension spring 84, and the arm 81 swings around the spindle 81*a* counterclockwise in FIG. 5.

The transmissive photosensor 83 as the detector detects the direction of displacement and the amount of displacement of the intermediate transfer belt 8 when the intermediate transfer belt 8 shifts toward one side (i.e., the belt deviation occurs). In other words, the transmissive photosensor 83 detects a direction of movement and an amount of movement of the contact member 82 (or the arm 81).

The transmissive photosensor 83 is disposed facing the slit 81*b* formed in the arm 81. Specifically, with reference to FIGS. 6A-1, 6B-1, and 6C-1, in the present embodiment, the transmissive photosensor 83 includes one light emitting element 83*a* and two light receiving elements 83*b*1 and 83*b*2 disposed across the slit 81*b* of the arm 81. The light receiving element 83*b*1 is positioned on the right side, and the light receiving element 83*b*2 is positioned on the left side in FIGS. 6A-1, 6B-1, and 6C-1. The transmissive photosensor 83 detects the direction of displacement and the amount of displacement of the intermediate transfer belt 8 (, the contact member 82, or the arm 81) based on an output change of the two light receiving elements 83*b*1 and 83*b*2.

By using such a transmissive photosensor 83 as the detector, the cost of the detection device can be reduced as compared with the cases in which a rangefinder is used as the detector, or a transmissive photosensor including a plurality of pairs of light emitting elements and light receiving elements is used as the detector.

Further, by using such a transmissive photosensor 83 as the detector, the detection accuracy by the detector can be improved as compared with the case in which a transmissive photosensor including one pair of light emitting element and light receiving element is used as the detector.

More specifically, the light emitted from the light emitting element 83*a* spreads radially and enters the two light receiving elements 83*b*1 and 83*b*2 through the slits 81*b*. The outputs of the light receiving elements 83*b*1 and 83*b*2 (i.e., sensor outputs) change according to an incident light level from the light emitting element 83*a*. FIGS. 6A-2, 6B-2, and 6C-2 are graphs illustrating waveforms of the sensor outputs of the light receiving elements 83*b*1 and 83*b*2. A right side peak of the waveform corresponds to the sensor output of the light receiving element 83*b*1 positioned on the right side, and a left side peak of the waveform corresponds to the sensor output of the light receiving element 83*b*2 positioned on the left side in FIGS. 6A-1, 6B-1, and 6C-1. The light receiving elements 83*b*1 and 83*b*2 are of the same type.

Figures 1, 6A:
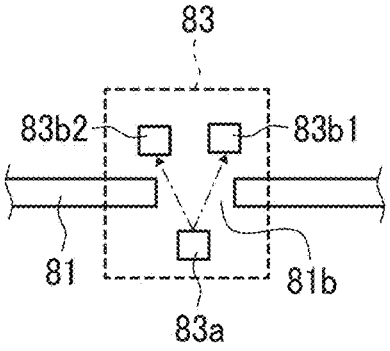
Figures 2, 6A:
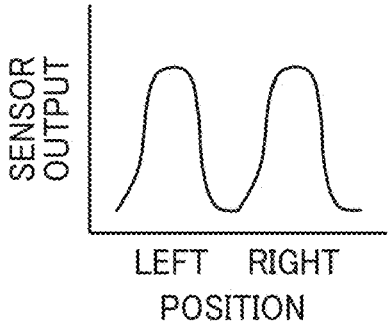

When the intermediate transfer belt 8 is not deviated from the specified position and is in a target posture, that is, when the slit 81*b* of the arm 81 is centered relative to the transmissive photosensor 83 as illustrated in FIG. 6A-1, the light emitted from the light emitting element 83*a* enters the two light receiving elements 83*b*1 and 83*b*2 substantially equally. As a result, as illustrated in FIG. 6A-2, the sensor output (voltage) of the two light receiving elements 83*b*1 and 83*b*2 has an output difference of almost zero. Therefore, when the transmissive photosensor 83 detects an output waveform as illustrated in FIG. 6A-2, the controller 90 determines that the intermediate transfer belt 8 is not deviated from the specified position (i.e., the belt deviation does not occur).

Figures 1, 6B:
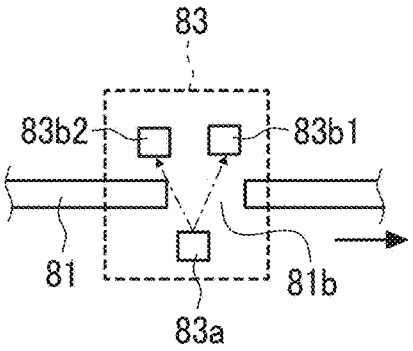
Figures 2, 6B:
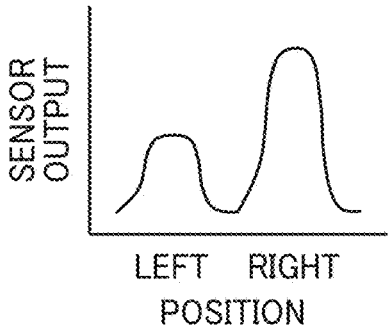

On the other hand, when the intermediate transfer belt 8 is deviated from the specified position toward one side, that is, when the slit 81*b* of the arm 81 moves to the right as indicated by the solid arrow in FIG. 6B-1 relative to the transmissive photosensor 83, a light incident level on the light receiving element 83*b*1 on one side (i.e., right side in FIG. 6B-1) is greater than the incident light level on the light receiving element 83*b*2 on the other side (i.e., left side in FIG. 6B-1). As a result, as illustrated in FIG. 6B-2, the sensor output of the light receiving element 83*b*1 on the one side is larger than that of the light receiving element 83*b*2 on the other side, and an output difference corresponding to the amount of movement of the intermediate transfer belt 8 is generated. Then, when the transmissive photosensor 83 detects such an output waveform as illustrated in FIG. 6B-2, the controller 90 determines the direction of movement and the amount of movement of the arm 81. Accordingly, the direction of movement (or displacement) and the amount of movement (or displacement) of the intermediate transfer belt 8 (or the contact member 82) are obtained.

Figures 1, 6C:
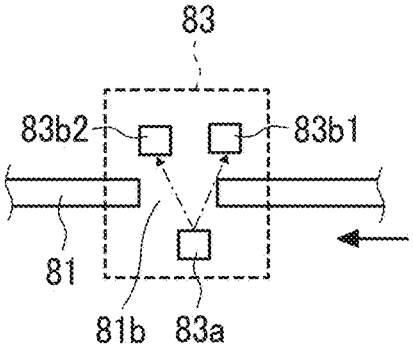
Figures 2, 6C:
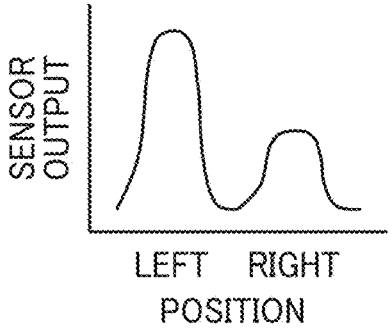

Similarly, when the intermediate transfer belt 8 is deviated from the specified position toward the other side, that is, when the slit 81*b* of the arm 81 moves to the left as indicated by the solid arrow in FIG. 6C-1 relative to the transmissive photosensor 83, the incident light level on the light receiving element 83*b*1 on the one side is less than the incident light level on the light receiving element 83*b*2 on the other side. As a result, as illustrated in FIG. 6C-2, the sensor output of the light receiving element 83*b*1 on the one side is smaller than that of the light receiving element 83*b*2 on the other side, and the output difference corresponding to the amount of movement of the intermediate transfer belt 8 is generated. Then, when the transmissive photosensor 83 detects such an output waveform as illustrated in FIG. 6C-2, the controller 90 determines the direction of movement and the amount of movement of the arm 81. Accordingly, the direction of movement and the amount of movement of the intermediate transfer belt 8 (or the contact member 82) are obtained.

Then, when the belt deviation detection device 80 detects the displacement (the direction of displacement and the amount of displacement) of the intermediate transfer belt 8, the correction roller 17 and the correction unit 91, which constitute the correction device, corrects the displacement of the intermediate transfer belt 8 in the width direction of the intermediate transfer belt 8 based on the detection result. That is, the correction roller 17 and the correction unit 91 function as the correction device that corrects the displacement of the intermediate transfer belt 8 in the width direction of the intermediate transfer belt 8 based on the detection result by the belt deviation detection device 80.

With reference to FIG. 3, the correction roller 17 is disposed on the upstream side in the direction of rotation of intermediate transfer belt 8 from photoconductor drums 1Y, 1M, 1C, and 1K and in contact with the inner circumference surface of intermediate transfer belt 8. With reference to FIG. 5, the correction roller 17 is configured to swings in the directions X1 and X2 around a pivot 17*a* as a drive cam of the correction unit 91 operates by a predetermined angle. Specifically, the controller 90 causes the drive cam of the correction unit 91 to rotate based on the detection result of the belt deviation detection device 80. The direction and angle of rotation of the drive cam is determined by the controller 90, thereby determining the direction and amount (or duration) to swing the correction roller 17 corresponding to the direction and angle of rotation of the drive cam.

With such a configuration, when the intermediate transfer belt 8 is displaced to the right in FIG. 5 (i.e., the belt deviation occurs), the transmissive photosensor 83 detects the direction of displacement and the amount of displacement, and then, based on the detection result, the correction roller 17 swings in the direction X2 to correct the displacement of the intermediate transfer belt 8. On the other hand, when the intermediate transfer belt 8 is displaced to the left in FIG. 5, the transmissive photosensor 83 detects the direction of displacement and the amount of displacement, and then, based on the detection result, the correction roller 17 swings in the direction X1 to correct the displacement of the intermediate transfer belt 8. As a result, a problem in which the intermediate transfer belt 8 meanders, and a problem in which the intermediate transfer belt 8 is broken when the intermediate transfer belt 8 is largely displaced in the width direction of the intermediate transfer belt 8 and in contact with other components are prevented.

Instead of changing the position of the shaft of the correction roller 17, the actuator can be used as the correction device to contact and bias the side portion of the intermediate transfer belt 8, thereby correcting the displacement of the intermediate transfer belt 8. As another example of the correction device, a portion of the casing of the intermediate transfer belt device 15, to which the tension spring 84 is coupled, may move to change the biasing force of the tension spring 84, thereby correcting the displacement of the intermediate transfer belt 8.

In the belt deviation detection device 80 according to the present embodiment, the contact member 82 is made of a metal material, and at least the contact portion of the contact member that contacts the intermediate transfer belt 8 is hardened (i.e., the hardening treatment is applied to the contact portion). That is, a method of manufacturing the contact member 82 includes hardening at least the contact portion that contacts the intermediate transfer belt 8. Specifically, after the contact member 82 is formed in a cylindrical shape by cutting, the hardening treatment is applied to the cylindrical contact member 82. Finally, the hardened contact member 82 is pressed into the arm 81.

More specifically, in the present embodiment, the heat treatment such as a quenching treatment or the surface modification treatment such as a diamond-like carbon treatment is used as the hardening treatment applied to the contact member 82. That is, in the method of manufacturing the contact member 82, after a process of forming the cylindrical contact member 82, a process of applying the heat treatment or the surface modification treatment to the cylindrical contact member 82 is performed. In the diamond-like carbon treatment, an amorphous hard film composed of a hydrocarbon or a carbon allotrope is formed on a target by plasma chemical vapor deposition (CVD) or physical vapor deposition (PVD).

Specifically, when the contact member 82 is made of stainless steel (SUS) 416 having high workability, a hardness of the contact member 82 is about 150 HV on Vickers hardness scale without the heat treatment. The hardness of the contact member 82 increases to about 300 HV with the quenching treatment, and the hardness of the contact member 82 increases to 1000 HV or more with the diamond-like carbon treatment.

Further, when the contact member 82 is made of SUS 440C having relatively high hardness, the hardness of the contact member 82 is about 250 HV on Vickers hardness scale without the heat treatment. The hardness of the contact member 82 increases to about 600 HV with the quenching treatment, and the hardness of the contact member 82 increases to 1000 HV or more with the diamond-like carbon treatment.

Furthermore, when the contact member 82 is made of SUS 630 having higher hardness than that of SUS 440C, the hardness of the contact member 82 is about 350 HV on Vickers hardness scale without the heat treatment. The hardness of the contact member 82 increases to about 600 HV with the quenching treatment, and the hardness of the contact member 82 increases to 1000 HV or more with the diamond-like carbon treatment.

As described above, the hardening treatment of the contact member 82 prevents the contact member 82 from wearing even if sliding contact with the intermediate transfer belt 8 lasts for a long time. Therefore, an error in the detection result of the displacement of the intermediate transfer belt 8 in the width direction of the intermediate transfer belt 8 by the belt deviation detection device 80 is hardly generated due to the wear of the contact member 82. That is, the displacement of the intermediate transfer belt 8 can be accurately corrected over time.

In a comparative method to reduce the wear of the contact portion of the contact member 82, a surface treatment to reduce a surface friction coefficient of the contact member 82 may be applied. However, if the surface friction coefficient of the contact member 82 is reduced, the surface hardness does not necessarily become higher. Accordingly, the wear of the contact member 82 may occur after long-term use, and the above-mentioned problems are not sufficiently solved. On the other hand, in the present embodiment, since the hardness of the contact portion of the contact member 82 is increased, the wear of the contact member 82 is reliably reduced, and the satisfactory detection accuracy of the belt deviation detection device 80 can be maintained over time.

In particular, in the present embodiment, the intermediate transfer belt 8 is configured to rotate at a high speed in the direction of rotation of the intermediate transfer belt 8 indicated by solid arrow A5 in FIG. 4. By the high-speed rotation, the wear of the contact member 82 is likely to occur. Therefore, a configuration in which the hardness of the contact member 82 is increased is useful.

When the transmissive photosensor 83 is used as the detector for detecting the displacement of the contact member 82 (or the arm 81) based on the change of the output waveform of the light receiving elements 83*b*1 and 83*b*2, the detection accuracy is likely to greatly change due to the wear of the contact member 82, as compared with the case in which a rangefinder that directly detects the displacement of the contact member 82 (or the arm 81) is used as the detector. Therefore, a configuration in which the hardness of the contact member 82 is increased is useful in the case in which the transmissive photosensor 83 is used as the detector.

Figure 7A:
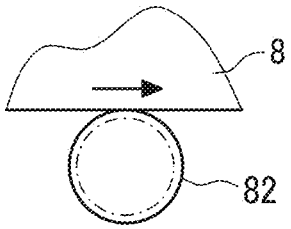
FIGS. 7A and 7B are top views illustrating a state in which a contact member of the belt deviation detection device is in contact with the belt of the belt device.
Figure 7B:
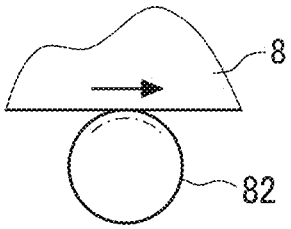

The hardening treatment can be applied to the entire outer circumference surface of the contact member 82 as illustrated by the dashed-dotted line in FIG. 7A. Alternatively, the hardening treatment can be applied to only a part of the outer circumference surface of the contact member 82, which is a part including at least the contact portion, as illustrated by the dashed-dotted line in FIG. 7B.

In the former case, as compared to the latter case, the contact member 82 can be secured to the arm 81 without worrying about an area to which the hardening treatment is applied in the contact member 82 (i.e., an orientation of the contact member 82 that is secured to the arm 81). Therefore, assembly efficiency of the belt deviation detection device 80 can be improved. On the other hand, in the latter case, since the area of the hardening treatment is smaller than in the former case, the cost of the contact member 82 can be reduced.

In the present embodiment, the contact member 82 is cylindrical.

As a result, the contact member 82 is in line contact with the intermediate transfer belt 8, thereby reducing the contact area between the contact member 82 and the intermediate transfer belt 8. Therefore, even if the intermediate transfer belt 8 swings in the direction perpendicular to the width direction of the intermediate transfer belt 8 (the direction perpendicular to the surface of the paper on which FIG. 5 is drawn), the contact member 82 is unlikely to swing due to the swing of the intermediate transfer belt 8. In addition, even if the attachment accuracy (attachment angle) of the contact member 82 relative to the intermediate transfer belt 8 varies, the detection result of the transmissive photosensor 83 hardly varies. Furthermore, the wear due to sliding contact between the contact member 82 and the intermediate transfer belt 8 is reduced. Therefore, the displacement of the intermediate transfer belt 8 in the width direction of the intermediate transfer belt 8 can be detected with high accuracy over time.

In the present embodiment, the contact member 82 is formed in a cylindrical shape. However, even if the contact member 82 is not formed in a cylindrical shape, for example, if the contact member 82 is formed in a semi-cylindrical shape, the curved contact portion of the semi-cylindrical shape can attain the same effect.

In the present embodiment, the contact member 82 is secured to the arm 81 so that the contact member does not rotate. Thus, unlike the case in which the cylindrical contact member 82 is rotatably mounted on the arm 81 about the central axis of the contact member 82, the detection accuracy of the transmissive photosensor 83 is prevented from varying due to the eccentricity of the contact member 82. Therefore, the displacement of the intermediate transfer belt 8 in the width direction of the intermediate transfer belt 8 can be corrected with high accuracy.

In the present embodiment, the drive roller 16 is disposed in the vicinity of the belt deviation detection device 80 as illustrated in FIG. 3.

Such a configuration reduces the displacement (swing) of the intermediate transfer belt 8 in the direction perpendicular to the surface of the intermediate transfer belt 8 (the direction perpendicular to the surface of the paper on which FIG. 5 is drawn) at the position of the belt deviation detection device 80 (or the contact member 82). That is, since the belt tension of the intermediate transfer belt 8 is increased by the drive roller 16, the displacement of the intermediate transfer belt 8 at the position of the belt deviation detection device 80 in the direction perpendicular to the surface of the intermediate transfer belt 8 is restricted. Therefore, the following drawback is prevented, that is, in addition to a detection component to be originally detected (i.e., the detection component in the width direction of the intermediate transfer belt 8), a displacement component in a direction different from the width direction of the intermediate transfer belt 8 and the direction of rotation of the intermediate transfer belt 8 is also detected by the belt deviation detection device 80. Therefore, the detection accuracy of the belt deviation of the intermediate transfer belt 8 by the belt deviation detection device 80 is further improved.

In the present embodiment, the correction roller 17 is disposed away from the belt deviation detection device 80. Specifically, the correction roller 17 is disposed on the upstream side in the direction of rotation of the intermediate transfer belt 8 from an opposing region where the photoconductor drums 1Y, 1M, 1C, and 1K are opposed to the intermediate transfer belt 8. The belt deviation detection device 80 is disposed downstream in the direction of rotation of the intermediate transfer belt 8 from the opposing region where the photoconductor drums 1Y, 1M, 1C, and 1K are opposed to the intermediate transfer belt 8.

As described above, since the belt deviation detection device 80 is disposed away from the correction roller 17, even if the correction roller 17 swings for correction operation, regulating force (i.e., restraint force of displacement in the perpendicular direction) on the intermediate transfer belt 8 by the drive roller 16 does not decrease, thereby improving the detection accuracy of the belt deviation detection device 80.

Further, in the intermediate transfer belt device 15 according to the present embodiment, the belt deviation detection device 80 is disposed away from the opposing region where the photoconductor drums 1Y, 1M, 1C, and 1K are opposed to the intermediate transfer belt 8. Specifically, the belt deviation detection device 80 and the drive roller 16 are disposed downstream in the direction of rotation of the intermediate transfer belt 8 from the opposing region where the photoconductor drums 1Y, 1M, 1C, and 1K are opposed to the intermediate transfer belt 8 (i.e., a position after the primary transfer process).

As a result, the intermediate transfer belt device 15 can be decreased in size as compared with the case in which the belt deviation detection device 80 is disposed in the opposing region where photoconductor drums 1Y, 1M, 1C, and 1K are opposed to the intermediate transfer belt 8. Furthermore, as compared with the case where the belt deviation detection device 80 is disposed in the above-mentioned opposing region, the maintainability of the belt deviation detection device 80 is improved, and a drawback is prevented that the belt deviation detection device 80 (the transmissive photosensor 83) malfunctions due to the noise caused by a high voltage power supply disposed near the image forming units 6Y, 6M, 6C, and 6K.

As described above, the belt deviation detection device 80 according to the above embodiments includes the contact member 82 and the transmissive photosensor 83 as a displacement detector. The contact member 82 is in contact with the intermediate transfer belt 8 as a belt by the biasing force of the tension spring 84 as a biasing member and configured to track the displacement of the intermediate transfer belt 8 in the width direction of the intermediate transfer belt 8. The transmissive photosensor 83 is configured to detect the direction of displacement and the amount of displacement of the intermediate transfer belt 8. The contact member 82 is made of a metal material and the hardening treatment is applied to at least the contact portion, which contacts the intermediate transfer belt 8, of the contact member 82.

As a result, the belt deviation detection device 80 can detect the displacement of the intermediate transfer belt 8 in the width direction of the intermediate transfer belt 8 with high accuracy over time.

Therefore, according to the present disclosure, a belt deviation detection device that can detect the displacement of the belt in the width direction of the belt with high accuracy over time, a belt device, an image forming apparatus incorporating the belt deviation detection device, and a method of manufacturing a contact member included in the belt deviation detection device can be provided.

It is to be noted that the above-described embodiments according to the present disclosure are applied to, but not limited to, the intermediate transfer belt device 15 in which the belt deviation of the intermediate transfer belt 8 as the belt is corrected. For example, the present disclosure can be applied to the secondary transfer belt device 69 to correct the belt deviation of the secondary transfer belt 72 according to the above embodiments, and further applied to a belt device including a belt such as a photoconductor belt, a direct transfer type transfer conveyance belt, a fixing belt, or the like.

Further, although in the above-described embodiments, the present disclosure is applied to the image forming apparatus 100 that forms color images, the present disclosure can also be applied to an image forming apparatus that forms only monochrome images.

Further, in the above-described embodiment, a displacement detector such as the transmissive photosensor 83 is configured to indirectly detect the direction of displacement (the direction of movement) and the amount of displacement (the amount of movement) of the intermediate transfer belt 8 (or the contact member 82). Alternatively, a displacement detector can be configured to directly detect the direction of displacement (the direction of movement) and the amount of displacement (the amount of movement) of the intermediate transfer belt 8 (or the contact member 82).

In such configurations, effects similar to those described above are also attained.

The above-described embodiments are illustrative and do not limit the present disclosure. Thus, numerous additional modifications and variations are possible in light of the above teachings. It is therefore to be understood that within the scope of the present disclosure, the present disclosure may be practiced otherwise than as specifically described herein. The number, position, and shape of the components described above are not limited to those embodiments described above. Desirable number, position, and shape can be determined to perform the present disclosure.

What is claimed is:

1. A belt deviation detection device comprising:

a contact member made of steel, the contact member including a contact portion disposed in contact with a rotary belt, the contact portion hardened to a hardness of at least 300 vickers harness (HV) by a hardening treatment, the contact member configured to track a lateral displacement of the rotary belt in a width direction of the rotary belt;

a biasing member configured to bias the contact member toward the rotary belt to press the contact member against the rotary belt; and a displacement detector configured to detect the lateral displacement of the rotary belt in the width direction of the rotary belt.

2. The belt deviation detection device according to claim 1, wherein the hardening treatment applied to the steel is a heat treatment.

3. The belt deviation detection device according to claim 1, wherein the hardening treatment applied to the steel is a surface modification treatment.

4. The belt deviation detection device according to claim 1, further comprising:

a spindle; and an arm having a slit, the arm configured to swing around the spindle, wherein the contact member is secured to the arm so that the contact member does not rotate, wherein the biasing member is a tension spring, one end of the tension spring coupled to the arm, and wherein the displacement detector is a transmissive photosensor opposed to the slit of the arm.

5. The belt deviation detection device according to claim 4, wherein the transmissive photosensor includes one light emitting element and two light receiving elements, and wherein the transmissive photosensor is configured to detect a direction of displacement and an amount of displacement of the rotary belt based on a change in output of the two light receiving elements.

6. The belt deviation detection device according to claim 1, wherein the contact member is cylindrical, and a circumference of the contact member contacts an end of the rotary belt in the width direction of the rotary belt.

7. A belt device comprising:

the belt deviation detection device according to claim 1; and the rotary belt.

8. The belt device according to claim 7, further comprising:

a correction device configured to correct the lateral displacement of the rotary belt in the width direction of the rotary belt based on a detection result provided by the belt deviation detection device.

9. An image forming apparatus comprising:

the belt device according to claim 7.

10. A method of manufacturing a contact member included in a belt deviation detection device configured to detect lateral displacement of a rotary belt that rotates in a direction, the method comprising:

forming the contact member from steel; and hardening at least a contact portion of the contact member that contacts the rotary belt to a hardness of at least 300 vickers harness (HV).

11. A method of detecting a lateral displacement of a rotary belt that rotates in a direction, the method comprising:

biasing a contact member made of steel toward the rotary belt with a biasing member;

bringing a contact portion of the contact member into contact with the rotary belt such that the contact member tracks the lateral displacement of the rotary belt, the contact portion hardened to a hardness of at least 300 vickers harness (HV) by a hardening treatment; and detecting a direction of displacement and an amount of displacement of the contact member with a displacement detector configured to detect the lateral displacement of the rotary belt.

12. The belt deviation detection device of claim 1, wherein the contact portion that is hardened is in continuous contact with the rotary belt when the rotary belt is laterally displaced.

13. The belt deviation detection device of claim 1, wherein the contact member is made of stainless steel (SUS).

14. The belt deviation detection device of claim 13, wherein the contact member is made of one of grade 416 stainless steel (SUS), grade 440C stainless steel (SUS) and grade 630 stainless steel (SUS).

15. The belt deviation detection device of claim 14, wherein the hardening treatment is a quenching treatment such that the hardness of the contact portion is at least 300 HV.

16. The belt deviation detection device of claim 14, wherein the hardening treatment is a diamond-like carbon treatment such that the hardness of the contact portion is at least 1000 HV.

17. The belt deviation detection device of claim 14, wherein only the contact portion of the contact member is hardened by the hardening treatment such that a non-contact portion of the contact member is unhardened.

18. The belt deviation detection device of claim 17, wherein the non-contact portion has a hardness of approximately 150 HV, when the contact member is made of grade 416 stainless steel (SUS), the non-contact portion has a hardness of approximately 250 HV, when the contact member is made of grade 440C stainless steel (SUS), and the non-contact portion has a hardness of approximately 350 HV, when the contact member is made of grade 630 stainless steel (SUS).

* * * * *